US008028453B2

(12) United States Patent
Fornataro

(10) Patent No.: US 8,028,453 B2
(45) Date of Patent: Oct. 4, 2011

(54) APPARATUS AND METHODS FOR DISPLAYING A CARD

(75) Inventor: Anthony A. Fornataro, Mays Landing, NJ (US)

(73) Assignee: Hold That Thought, Inc., Madison, NJ (US)

( * ) Notice: Subject to any disclaimer, the term of this patent is extended or adjusted under 35 U.S.C. 154(b) by 23 days.

(21) Appl. No.: 11/890,045

(22) Filed: Aug. 4, 2007

(65) Prior Publication Data

US 2008/0023419 A1 Jan. 31, 2008

Related U.S. Application Data

(63) Continuation-in-part of application No. 29/226,730, filed on Jun. 16, 2005, now abandoned.

(51) Int. Cl.
*G09F 1/00* (2006.01)

(52) U.S. Cl. ..... 40/745; 40/539; 40/606.01; 40/124; D19/90; 248/441.02; 248/473; 248/174

(58) Field of Classification Search ..... 40/124.09, 40/124.06, 124.19, 538; 248/476, 453, 174.1, 248/176.1

See application file for complete search history.

(56) References Cited

U.S. PATENT DOCUMENTS

| | | | | | |
|---|---|---|---|---|---|
| 1,927,635 | A | * | 9/1933 | Garfunkel | 248/452 |
| 2,447,856 | A | | 8/1948 | Hazelton | |
| D157,082 | S | | 1/1950 | Patton | |
| 2,865,122 | A | | 12/1958 | Clawson | |
| 2,913,843 | A | | 11/1959 | Wittick | |
| 3,483,742 | A | | 12/1969 | Murray | |
| 3,599,360 | A | | 8/1971 | Lappo | |
| 3,797,149 | A | | 3/1974 | Morrison | |
| 3,987,566 | A | | 10/1976 | March | |
| 4,186,503 | A | | 2/1980 | Fontana | |
| 4,213,531 | A | | 7/1980 | Rae | |
| 4,315,376 | A | | 2/1982 | Eichenauer | |
| 4,470,647 | A | * | 9/1984 | Bishoff et al. | 312/111 |
| 4,630,824 | A | * | 12/1986 | Sweet | 273/150 |
| 4,712,760 | A | * | 12/1987 | Winter | 248/451 |
| 4,993,560 | A | | 2/1991 | Jaffe | |
| D317,732 | S | | 6/1991 | Vernon | |
| 5,042,760 | A | | 8/1991 | Boschetto | |
| D324,832 | S | | 3/1992 | Boschetto et al. | |
| 5,242,062 | A | | 9/1993 | Engravalle | |
| D344,248 | S | | 2/1994 | Wiggins | |
| D354,454 | S | | 1/1995 | Vernon | |
| 5,531,038 | A | | 7/1996 | Keith | |

(Continued)

FOREIGN PATENT DOCUMENTS

GB 2379634 A 3/2003

*Primary Examiner* — Cassandra Davis
(74) *Attorney, Agent, or Firm* — Chipperson Law Group

(57) ABSTRACT

Apparatus and methods for displaying a card via a decorative figurine, or similar device, equipped with one or more card retention mechanisms. In one embodiment, the retention mechanisms are arranged in a V shape to allow a card placed therein to be retained in a partially open state. In another embodiment, upper projections may be included to provide further stability to the retained card. In some embodiments, the apparatus is in the form of a quadruped, the retention mechanisms are integral to or coupled to the quadruped's legs, and the upper projections are in the form of the quadruped's arms. In another embodiment, a tent-style card is held between upper and lower retention mechanisms. In another embodiment, the card is permanently adhered to the figurine.

7 Claims, 6 Drawing Sheets

U.S. PATENT DOCUMENTS

| | | | | | |
|---|---|---|---|---|---|
| 5,603,175 | A | | 2/1997 | Brenner | |
| D379,075 | S | | 5/1997 | Edler | |
| D383,909 | S | * | 9/1997 | Salas | D6/310 |
| 5,829,176 | A | | 11/1998 | Gruneisen, III | |
| 5,911,328 | A | | 6/1999 | Shampo | |
| 5,975,317 | A | | 11/1999 | Roebling | |
| 6,227,504 | B1 | | 5/2001 | Seaberg | |
| D454,702 | S | * | 3/2002 | Doeing | D6/310 |
| 6,575,803 | B1 | | 6/2003 | Liu | |
| 6,698,598 | B1 | | 3/2004 | Appenteng | |
| D545,095 | S | | 6/2007 | Lomas | |
| 7,322,139 | B2 | * | 1/2008 | Holcomb | 40/700 |

* cited by examiner

FIG. 9
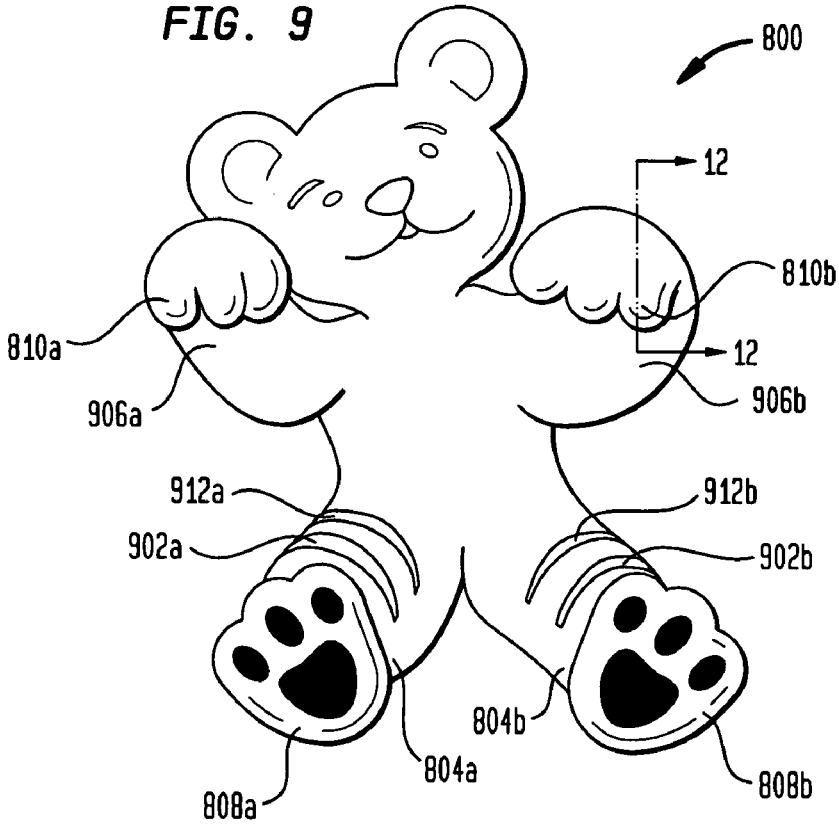
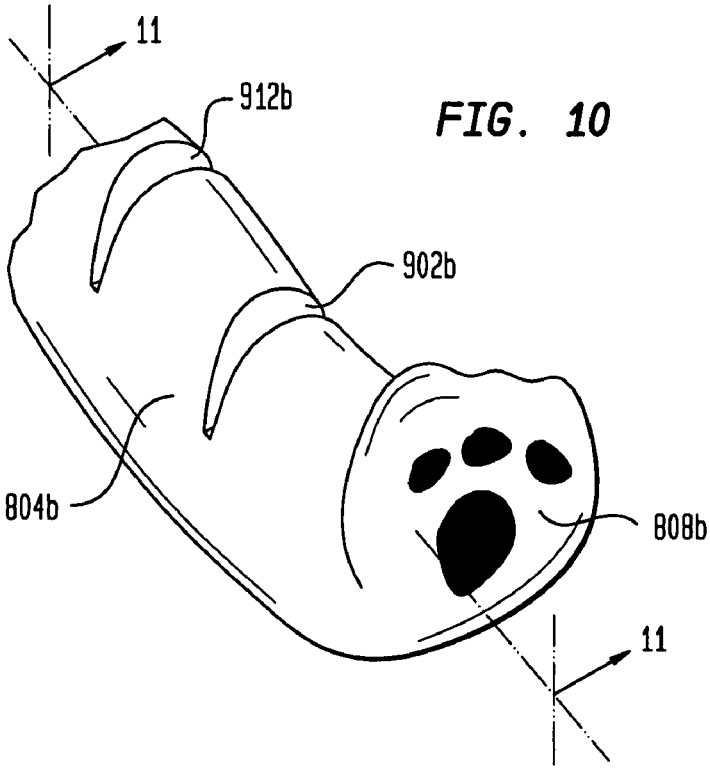
FIG. 10

APPARATUS AND METHODS FOR DISPLAYING A CARD

CROSS-REFERENCE TO RELATED APPLICATIONS

This application claims the benefit of and is a continuation-in-part of the U.S. design patent application entitled "Card Cuddler", having Ser. No. 29/226,730, filed Jun. 16, 2005, now abandoned which is incorporated by reference in its entirety as if fully set forth herein.

BACKGROUND OF THE INVENTION

1. Field of the Invention

Embodiments of the present invention generally relate to apparatus and methods for displaying a card. More specifically, the present invention relates to apparatus and methods for displaying a card, such as a greeting card, seating card, and the like, via a decorative figurine, or similar device, equipped with one or more card retention mechanisms.

2. Description of the Related Art

Apparatus for displaying a plurality of greeting cards are known in the art. One such device for displaying greeting cards and the like comprises a flat, relatively thin display member which is secured to a flat mounting surface of a selected support, such as a wall, door or mirror. The greeting cards are inserted into slots in the member, the inserted portion of a card being captured in a narrow space that is provided between the display member and the mounting surface. Special securing means on the member serve as spacers to maintain the narrow capture space and hold the displayed portion of each card in an upright position to be viewed.

Another apparatus for displaying a plurality of greeting cards includes a housing having a channel designed to rest on a support surface. The housing has a plurality of display arm assemblies which may be selectively coupled to the housing and pivot sideways with respect to the housing for the purpose of paging through the greeting cards. The display arms are telescopic thereby allowing them to adjust to various sizes of cards. There is a lighted section at the top of the housing for ornamental purposes, and the housings are designed as a stand-alone version, one that can encompass a circular member such as a Christmas tree, or one designed to be coupled to a flat or corner wall surface.

Also known are apparatus for displaying a single greeting card. One such apparatus is in the form of a blank and the stand formed therefrom for holding and supporting cards. The stand can display creased greeting cards either horizontally or vertically. The blank includes a triangular-shaped base section having in its first adaptation, a pair of diverging side panels and diverging foldable joints, and in its second adaptation, a pair of opposed side panels and parallel foldable joints. Adhesive means are further provided for attaching and placing the blank/stand in the desired position and location.

Another known device for supporting a folded greeting card in an open position includes a linear base member having an abutment means at each end thereof. Each abutment means includes a slot therein for holding each side of a greeting card. In another embodiment of this same device, the abutment means are eliminated and slots are formed directly in the base member.

BRIEF SUMMARY OF THE INVENTION

Briefly stated, in one aspect of the present invention, an apparatus for displaying a card is provided. This apparatus includes a figurine; and at least two retention mechanisms internal to or coupled to the figurine, the at least two retention mechanisms configured to accept at least a portion of a bottommost surface of a card; and said at least two retention mechanisms arranged in a V shape; wherein the figurine is a quadruped; wherein at least one of the at least two retention mechanisms is located in or coupled to at least one leg of said quadruped; and wherein at least one of the at least two retention mechanisms is at least one of the group consisting of a linear recess, a clip, a magnet, and combinations thereof.

In another aspect of the present invention, an apparatus for displaying a card is also provided. This apparatus includes a figurine, at least one lower retention mechanism internal to or coupled to the figurine configured to accept at least one bottom of at least one side of the card, and at least one upper retention mechanism or coupled to the figurine configured to accept at least one top of at least one card; wherein the card is irremovably coupled to the figurine.

In yet another aspect of the present invention, an apparatus for displaying a card is also provided. This apparatus includes a figurine, at least one lower retention mechanism internal to or coupled to said figurine configured to accept at least one bottom of at least one side of the card, and at least one upper retention mechanism or coupled to said figurine configured to accept at least one top of at least one card.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 9 is a perspective view of an alternate apparatus for displaying a card without a retained card in accordance with an alternate embodiment of the present invention;

FIG. 10 is a magnified view of the left lower retention mechanism of the apparatus depicted in FIG. 8;

DETAILED DESCRIPTION OF THE INVENTION

Figure 1:
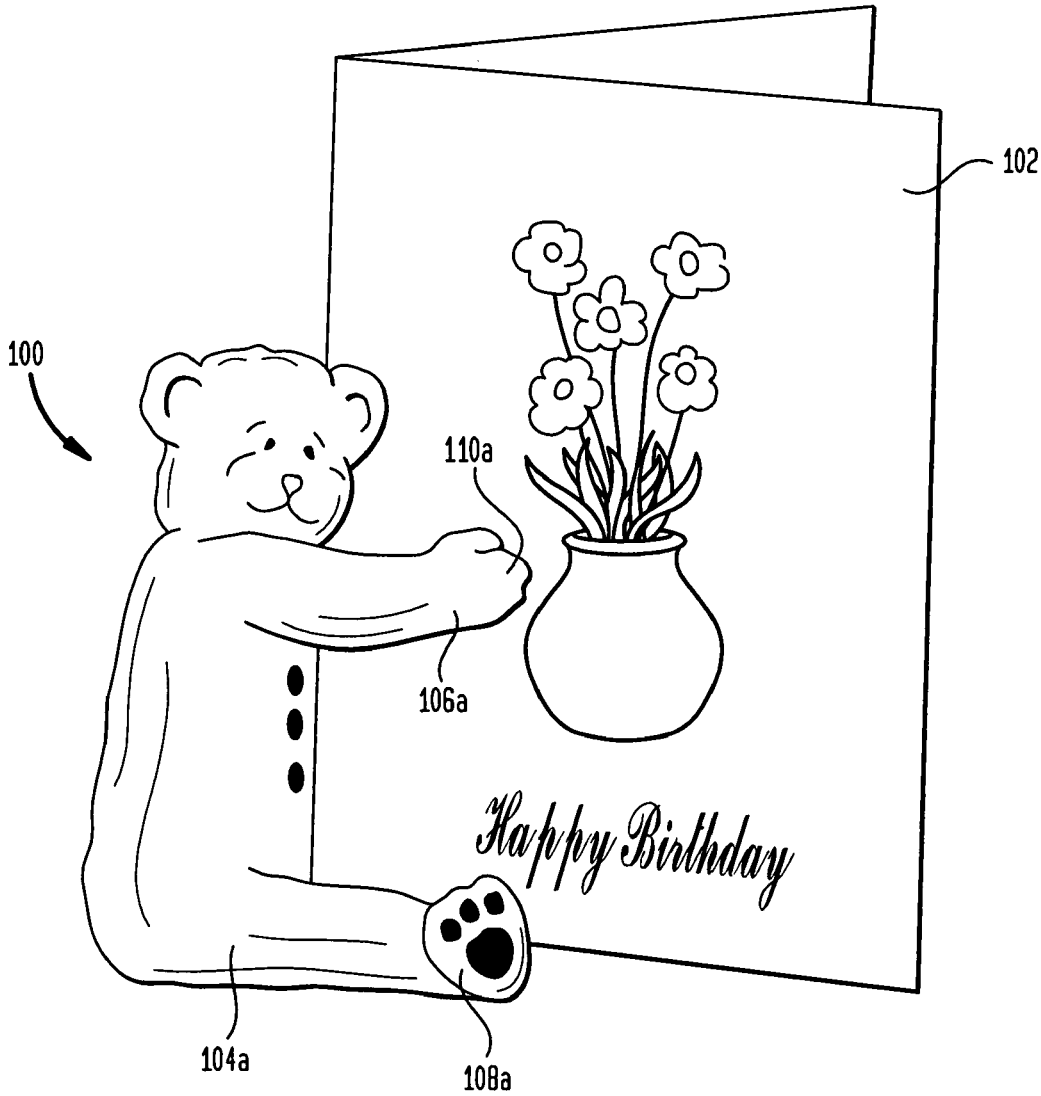
FIG. 1 is a perspective view of one apparatus for displaying a card in accordance with one embodiment of the present invention.

Referring first to FIG. 1, depicted is card display apparatus 100 in accordance with one embodiment of the present invention. In one aspect of the present invention, card display apparatus 100 displays a greeting card (e.g., greeting card 102) or the like in a partially open state such that both the exterior and interior of the displayed material is viewable without disruption of same. The securing of the card to card display apparatus 100 also allows the apparatus to be rotated for viewing of the card interior without causing disruption to the displayed card. Use of card display apparatus 100 also minimizes the potential for disruption of retained cards by forces such as pets, wind or other air movements, etc.

Figure 2:
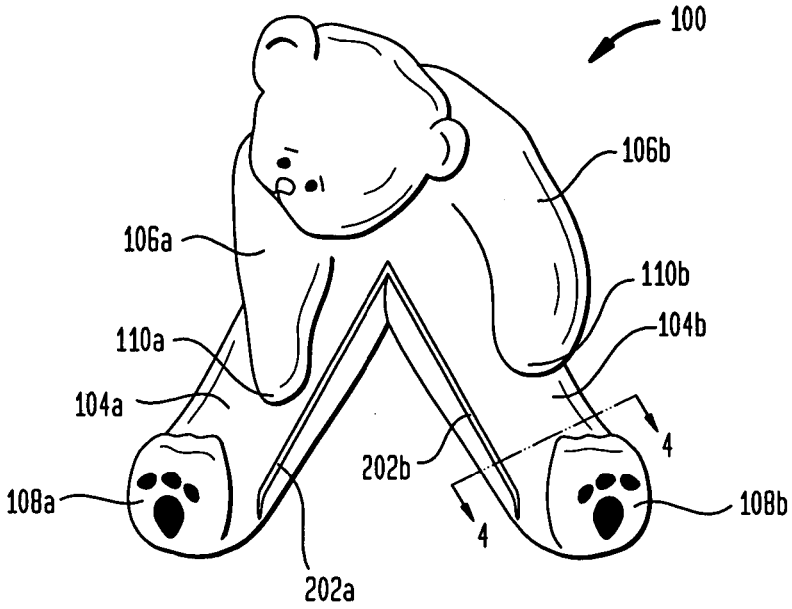
FIG. 2 is a top view of the apparatus depicted in FIG. 1.

In the embodiment of the present invention depicted in FIG. 1, card display apparatus 100 is shaped in the form of a seated bear and it includes, inter alia: right and left legs 104*a* and 104*b* (FIG. 1 and FIG. 2), respectively; right and left arms 106*a* and 106*b* (FIG. 1 and FIG. 2), respectively; right and left paws 108*a* and 108*b* (FIG. 1 and FIG. 2), respectively; and right and left retention mechanisms 202*a* and 202*b*, respectively (FIG. 2). In this embodiment of the present invention, each retention mechanism is a linear recess. However, alternate forms of retention mechanisms may be substituted without departing from the scope of the present invention including, without limitation, magnets.

Turning next to FIG. 2, depicted is a top view of card display apparatus 100. This view illustrates retention mechanisms 202*a* and 202*b*, respectively, which in this embodiment of the present invention, extend along the length of right and left legs 104*a* and 104*b*, respectively. Retention mechanisms 202 allow the bottom edges of the left and right sides of a greeting card to be positioned therein such that the greeting card may be retained in an upright state (such as greeting card 102 as depicted in FIG. 1).

In the embodiment of the present invention depicted in FIG. 1, each of retention mechanisms 202 are positioned at an approximately thirty degree angle relative to an axis of symmetry passing through their point of intersection. This positioning results in a combined recess in the form of the letter "V". Placement of the left and right sides of a greeting card in retention mechanism 202*a* and 202*b*, respectively, retains the greeting card in a partially open state in which both the exterior and interior of both the left and right sides of the greeting card may be viewed without removing the greeting card from card display apparatus 100. Although card display apparatus 100 depicts two retention mechanisms located at thirty degree angles relative to an axis of symmetry, embodiments having varying angles may be substituted without departing from the scope of the present invention.

Also depicted in the top view of FIG. 2 is the slight curvature of arms 106. In some embodiments of the present invention, arms or other forms of upper projections are included to provide upper support to the retained card. Optimally, arms 206 are positioned such that they will allow the upper end of the card to open to the same degree as the lower end of the card, as determined by the angle of retention mechanism 202. In some such embodiments, the upper projections are curved or otherwise positioned inward to allow the inwardly facing sides of the distal ends of such projections (e.g., distal ends 110) to physically contact the exterior surfaces of one or more sides of the retained card. Such contact provides additional support for the retained card. However, upper support (in the form of upper projections or otherwise) is not required to implement the present invention. Additionally, right and left arms 106*a* and 106*b*, respectively, may have equal or varying curvatures without departing from the scope of the present invention.

Figure 3:
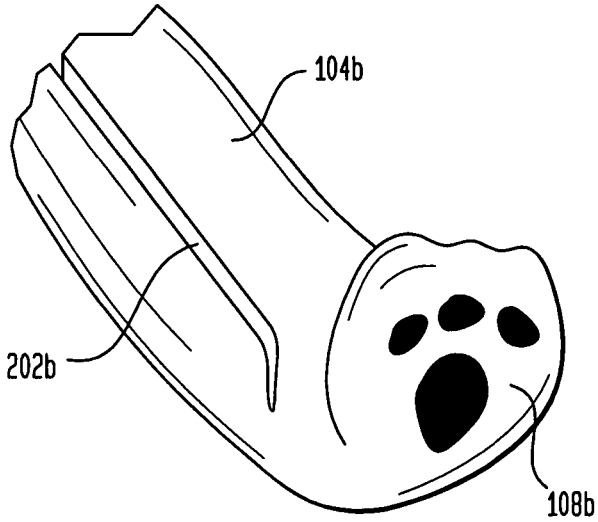
FIG. 3 is a magnified view of the left retention mechanism of the apparatus depicted in FIG. 1.

Turning next to FIG. 3, depicted is a magnified view of left retention mechanism 202*b*. As seen in this view, left paw 108*b* is offset relative to left retention mechanism 202*b*. Such offsetting allows a width of a card inserted into retention mechanism 202*b* to extend beyond the length of left leg 104*b* without being obstructed by paw 108*b*. Such configuration allows larger cards to be retained via card display apparatus 100 (FIGS. 1 and 2). However, alternate embodiments of the present invention are envisioned in which left paw 108*b* is not offset relative to left retention mechanism 202*b*. In such embodiments, retention mechanisms 202 may pass through paws 108.

Figure 4:
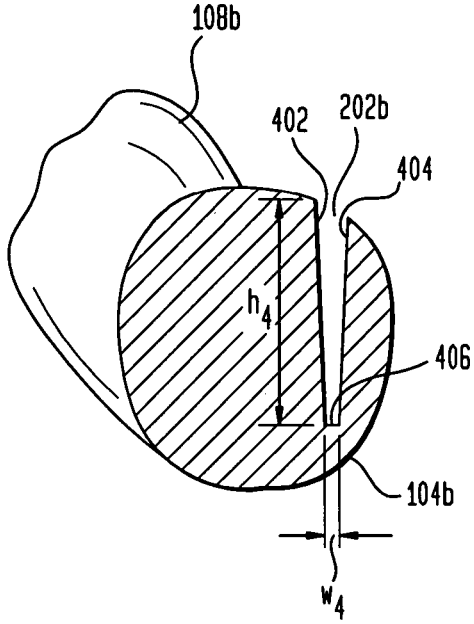
FIG. 4 is a cross-sectional view of the apparatus depicted in FIG. 2 taken along lines 4-4 of FIG. 4.

Referring now to FIG. 4, depicted is a cross-sectional view taken along lines 4-4 of FIG. 2, which illustrates the configuration of retention mechanism 202*b*, which, in this embodiment of the present invention, is a mirror image of retention mechanism 202*a*. In one embodiment of the present invention, the height $h_4$ of retention mechanism 202 is approximately three-eighths of an inch (3/8") and the width $w_4$ of retention mechanism 202 tapers from a narrowest width of one-hundredth of an inch (1/100") at its bottommost point to a widest width of one thirty-second of an inch (1/32") at its uppermost point. In the embodiment of the present invention depicted in FIGS. 1-4, the length of retention mechanism 202 is slightly less than the length of the corresponding leg 104 in which retention mechanism 202 is located. However, varying lengths, widths, and heights may be substituted without departing from the scope hereof (e.g., retention mechanism 202 may be equal to the length of the corresponding leg 104).

As seen in this cross-sectional view, a first innermost vertical surface 402 of retention mechanism 202 is substantially vertical and a second outermost vertical surface 404 of retention mechanism 202 is tapered in an outward direction. Innermost vertical surface 402 provides interior support for a card inserted into a corresponding retention mechanism 202 whereas the tapering of outermost vertical surface 404 accommodates card sides of varying widths. That is, retention mechanism 202 allows cards having thinner sides to be inserted closer to bottom surface 406 of retention mechanism 202 while allowing cards having thicker sides to be inserted to a point located at a farther distance from bottom surface 406. That is, cards having thinner sides may be inserted further within retention mechanisms 202 whereas cards have thicker sides may be inserted to a lesser degree within retention mechanisms 202. However, retention mechanisms having non-tapered sides may be substituted without departing from the scope of the present invention.

Figure 5:
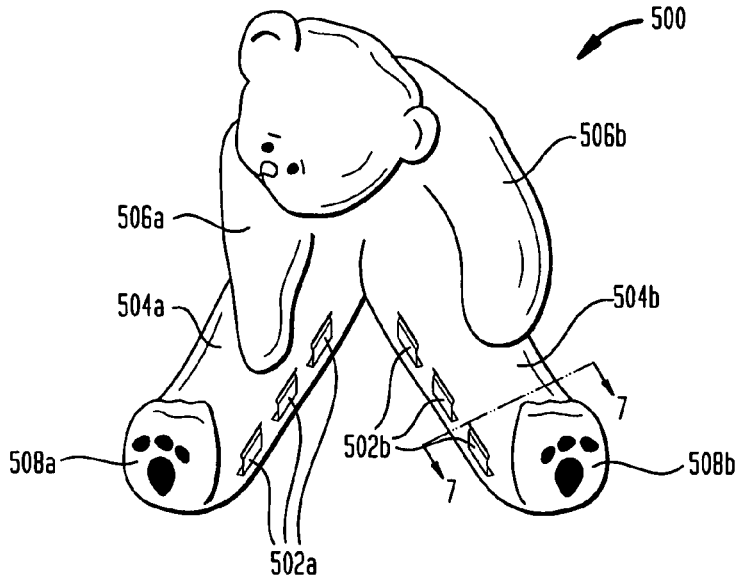
FIG. 5 is a top view of one apparatus for displaying a card having an alternate retention mechanism in accordance with an alternate embodiment of the present invention.

Referring now to FIG. 5, depicted is card display apparatus 500 in accordance with an alternate embodiment of the present invention. In one aspect of the present invention, card display apparatus 500 displays a greeting card or the like in a partially open state such that both the exterior and interior of the displayed material is viewable without disruption of same. The securing of the card to card display apparatus 500 also allows the apparatus to be rotated for viewing of the card interior without causing disruption to the displayed card. Use of card display apparatus 500 also minimizes the potential for disruption of retained cards by forces such as pets, wind or other air movements, etc.

In the embodiment of the present invention depicted in FIG. 5, card display apparatus 100 is shaped in the form of a seated bear and it includes, inter alia: right and left legs 504*a* and 504*b*, respectively; right and left arms 506*a* and 506*b*, respectively; right and left paws 508*a* and 508*b*, respectively;

and right and left retention mechanisms 502*a* and 502*b*, respectively. In this embodiment of the present invention, each retention mechanism 502*a* and 502*b* is a set of three clips, which in this embodiment of the present invention, are located along the length of right and left legs 504*a* and 504*b*, respectively. Retention mechanisms 502 allow the bottom edges of the left and right sides of a greeting card to be positioned therein such that the greeting card may be retained in an upright state. However, alternate forms of retention mechanisms may be substituted without departing from the scope of the present invention. For example, pairs of magnets may be substituted in which one or more first magnets are affixed to the figurine and a portion of the card is affixed to the first magnet(s) via placement of one or more second magnets on the opposite side of the card portion such that the magnets magnetically attract each other (i.e., the card is sandwiched between pairs of magnets positioned or otherwise designed to magnetically attract).

In the embodiment of the present invention depicted in FIG. 5, each retention mechanism 502 is positioned at a thirty degree angle relative to an axis of symmetry passing through their point of intersection. This positioning results in a combined clippable area in the form of the letter "V". Placement of the left and right sides of a greeting card in retention mechanisms 502*a* and 502*b*, respectively, retains the greeting card in a partially open state in which both the exterior and interior of both the left and right sides of the greeting card may be viewed without removing the greeting card from card display apparatus 500. Although card display apparatus 500 depicts two retention mechanisms located at thirty degree angles relative to an axis of symmetry, embodiments having varying angles may be substituted without departing from the scope of the present invention.

Also depicted in the top view of FIG. 5 is the slight curvature of arms 506. In some embodiments of the present invention, arms or other forms of upper projections are included to provide upper support to the retained card. Optimally, arms 506 are positioned such that they will allow the upper end of the card to open to the same degree as the lower end of the card, as determined by the angle of retention mechanism 502. In some such embodiments, the upper projections are curved or otherwise positioned inward to allow the inwardly facing sides of the distal ends of such projections (e.g., distal ends 510) to physically contact the exterior surfaces of one or more sides of the retained card. Such contact provides additional support for the retained card. However, upper support (in the form of upper projections or otherwise) is not required to implement the present invention. Additionally, right and left arms 506*a* and 506*b*, respectively, may have equal or varying curvatures without departing from the scope of the present invention.

Figure 6:
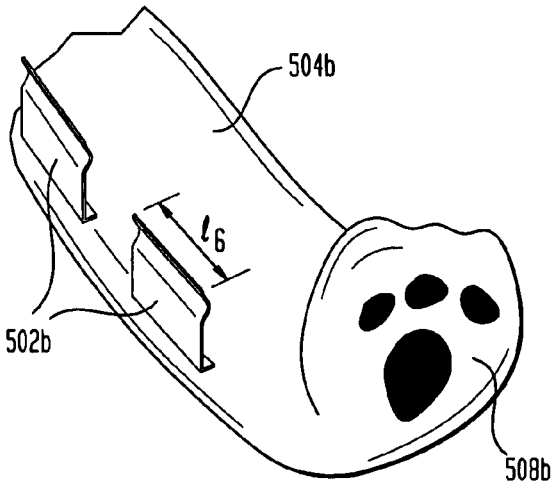
FIG. 6 is a magnified view of the left retention mechanism of the apparatus depicted in FIG. 5.

Turning next to FIG. 6, depicted is a magnified view of left retention mechanism 502*b*. As seen in this view, left paw 508*b* is offset relative to left retention mechanism 502*b*. Such offsetting allows a width of a card inserted into retention mechanism 502*b* to extend beyond the length of left leg 504*b* without being obstructed by paw 508*b*. Such configuration allows larger cards to be retained via card display apparatus 500. However, alternate embodiments of the present invention are envisioned in which left paw 508*b* is not offset relative to left retention mechanism 502*b*.

Figure 7:
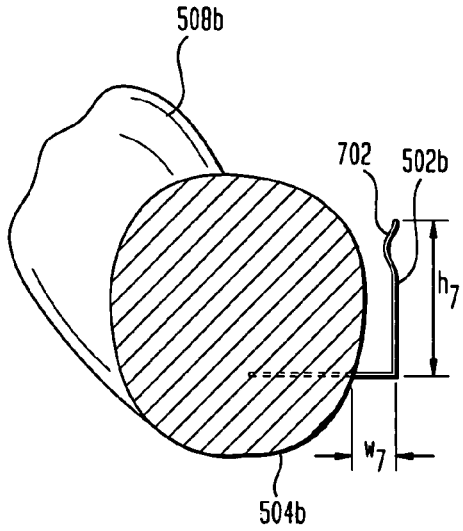
FIG. 7 is a cross-sectional view of the apparatus depicted in FIG. 5 taken along lines 7-7 of FIG. 5.

Referring now to FIG. 7, depicted is a cross-sectional view taken along lines 7-7 of FIG. 5, which illustrates the location and configuration of retention mechanism 502*b*, which is a mirror image of retention mechanism 502*a*. In one embodiment of the present invention, the height $h_7$ of each clip of retention mechanism 502 is approximately three-eighths of an inch (3/8"), the width $w_7$ of each clip varies from approximately one-hundredth of an inch (1/100") to one thirty-second of an inch (1/32"), and the length $l_6$ of each clip (FIG. 6). is approximately three-eighths of an inch (3/8"). However, varying lengths, widths, and heights may be substituted without departing from the scope hereof As seen in this cross-sectional view, each clip of retention mechanism 502*b* may be mounted to the body of card display apparatus 100 by extending its base inward into its respective leg 504. In the clay or plastic embodiments of the present invention, the base may be forced into the clay or plastic prior to curing or drying of same, and such materials may simply adhere to the surface of the clip during the curing or drying process. The clip may be formed of clay, plastic, metal, or any other suitable material capable of adhering to the body of card display apparatus 500. Or, other methods of affixing a clip to card display apparatus 500 may be substituted including, without limitation, screwing, nailing, adhesive, etc. In such embodiments, the base of the clip may or may not extend into the body of card display apparatus 500.

In the embodiment of the present invention depicted in FIG. 7, each retention mechanism 502*b* includes an inward curvature 702 in the upper end of the otherwise substantially vertical clip. In one aspect of the present invention, each clip of retention mechanism 502*b* is spring-loaded to retain the innermost surface of inward curvature 702 in contact with a card placed therein. Inward curvature 702 accommodates card sides of varying widths as the lower end of the clip has a width wider than the widest standard card and the inward curvature 702 extends inward to physically contact the surface of a card that is less than the width w of retention mechanism 502. That is, inward curvature 702 applies pressure to cards having sides with a width that is thinner than width w, whereas the full width w accommodates cards having thicker sides. However, retention mechanisms without inward curvatures may be substituted without departing from the scope of the present invention.

In addition to the added retention capabilities of arms 106 and 506, arms 106 and 506 allow card display apparatus 100 and 500 to be molded as a character or animal that is displayed as cuddling, or hugging, the card. This feature adds to the aesthetic appeal of the apparatus.

Additionally, card display apparatus 100 and 500 include a bear that is facing, or looking over, its right shoulder. This position allows a viewer to simultaneously view the face of the figurine and the front face of the card retained therein, which adds to the aesthetic appeal of card display apparatus 100 and 500. However, embodiments in which the figurine's face does not overlook its right shoulder may be substituted without departing from the scope of the present invention.

Figure 8:
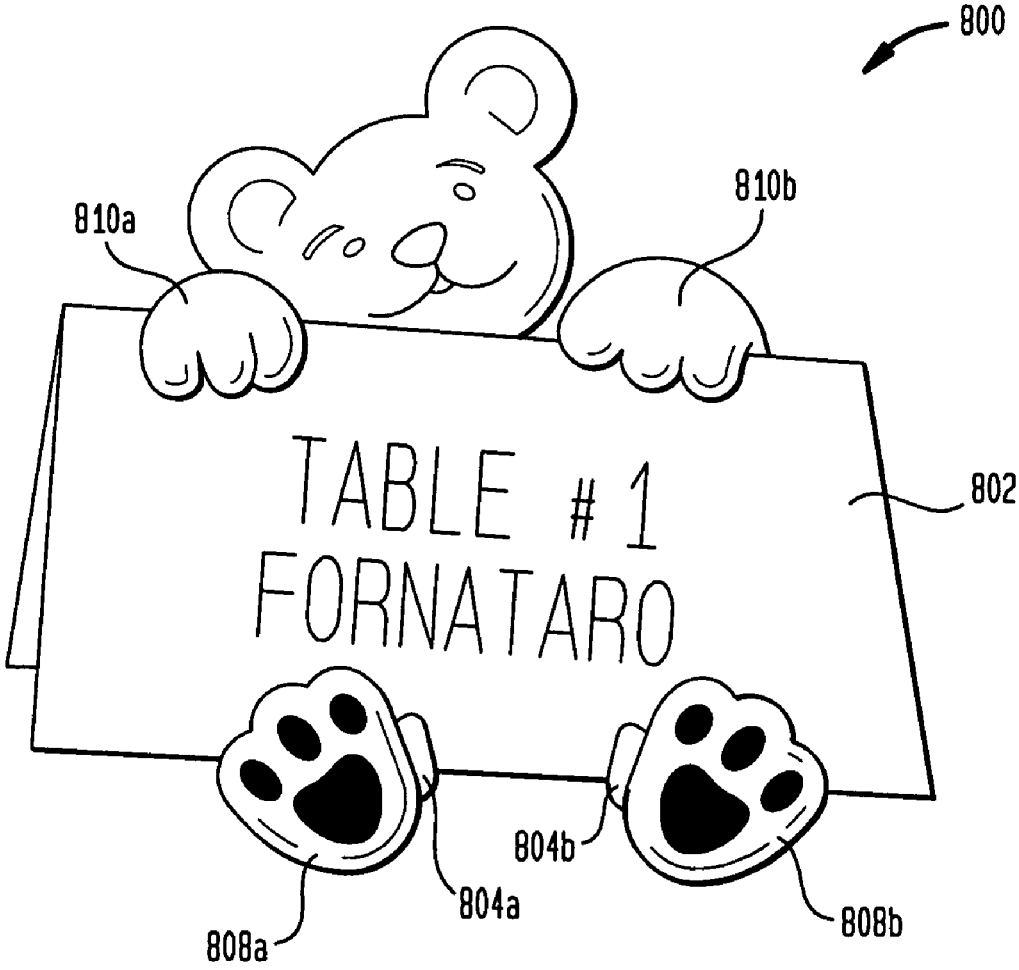
FIG. 8 is a perspective view of an alternate apparatus for displaying a card and a retained card in accordance with an alternate embodiment of the present invention.

Referring now to FIG. 8, depicted is card display apparatus 800 having a card retained therein in accordance with one embodiment of the present invention. In one aspect of the present invention, card display apparatus 800 displays the front of a tent-style card (e.g., seating card 802) or the like. The securing of the card to card display apparatus 800 minimizes the potential for disruption of retained cards by forces such as pets, wind or other air movements, etc.

In the embodiment of the present invention depicted in FIG. 8, card display apparatus 800 is shaped in the form of a seated bear and it includes, inter alia: right and left legs 804*a* and 804*b*, respectively; right and left arms 906*a* and 906*b* (FIG. 9), respectively; right and left lower paws 808*a* and 808*b*, respectively; right and left upper paws 810*a* and 810*b*, respectively, right and left lower retention mechanisms 902*a*/912*a* and 902*b*/912*b*, respectively (FIG. 9), right upper retention mechanism 1202*a* (FIG. 12), and left upper retention mechanism (not shown). In this embodiment of the present invention, each upper retention mechanism 1202 is a single inverted linear recess and each lower retention mechanism includes a pair of parallel linear recesses 902 and 912. However, alternate forms of retention mechanisms may be substituted without departing from the scope of the present invention including, without limitation, clips and magnets.

Turning next to FIG. 9, depicted is a perspective view of card display apparatus 800 without a card. This view illustrates the location of the lower retention mechanisms, which include a pair of parallel linear recesses 902*a*/902*b* and 912*a*/912*b*. In this embodiment of the present invention, linear recesses 902 and 912 are transverse to the length of right and left legs 804*a* and 804*b*, respectively. Linear recesses 902 are located near the distal end of each leg 804 and linear recesses 912 are located at the approximate midpoint of leg 804. Retention mechanisms 902 and 912 allow the bottom edges of the front and back sides, respectively, of a tent-style card to be positioned therein such that the card may be retained in an upright state (such as seating card 802 as depicted in FIG. 8).

In the embodiment of the present invention depicted in FIG. 1, retention mechanism 902*a* and 912*a* is positioned to align with retention mechanism 902*b* and 912*b*, respectively, such that a straight front or back side, respectively, may sit therein and span the distance between legs 804*a* and 804*b*. Although card display apparatus 800 depicts two linear recesses for each lower retention mechanism, lower retention mechanisms having a single linear recess may be substituted without departing from the scope of the present invention.

Figure 11:
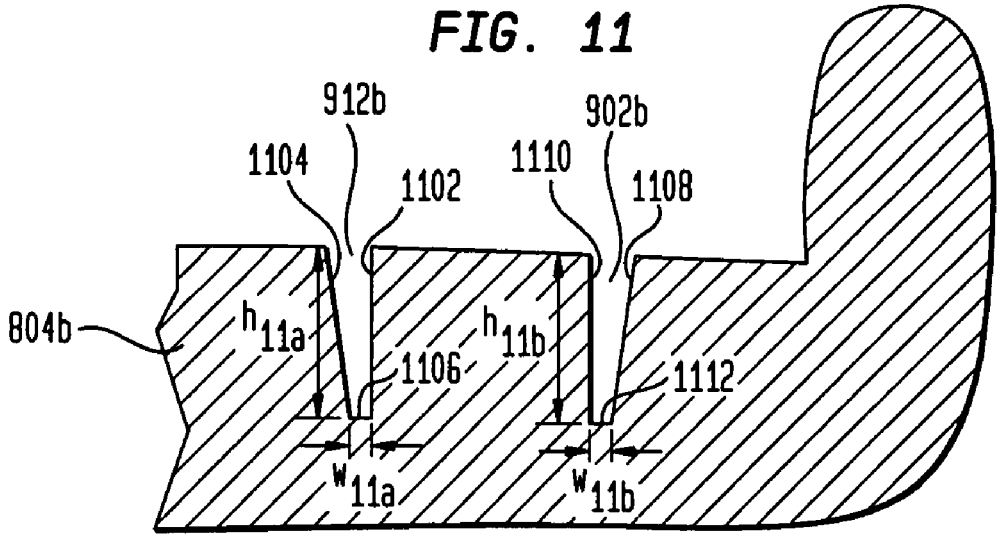
FIG. 11 is a cross-sectional view of the left lower retention mechanism of the apparatus depicted in FIG. 8 taken along lines 11-11 of FIG. 10.

Turning next to FIGS. 10 and 11, depicted are a magnified perspective view and a cross-sectional view, respectively, of the left retention mechanism, which includes linear recesses 902*b* and 912*b*. The cross-sectional view depicted in FIG. 11 illustrates the configuration of linear recesses 902*b* and 912*b*, which, in this embodiment of the present invention, are identical to linear recesses 902*a* and 912*a*. In one embodiment of the present invention, the height $h_{11b}$ of linear recesses 902 is approximately three-eighths of an inch (3/8") and the width $w_{11b}$ of linear recesses 902 tapers from a narrowest width of one-hundredth of an inch (1/100") at its bottommost point to a widest width of one thirty-second of an inch (1/32") at its uppermost point. Similarly, the height $h_{11a}$ of linear recesses 912 is approximately three-eighths of an inch (3/8") and the width $w_{11a}$ of linear recesses 912 tapers from a narrowest width of one-hundredth of an inch (1/100") at its bottommost point to a widest width of one thirty-second of an inch (1/32") at its uppermost point. In the embodiment of the present invention depicted in FIGS. 8-12, the length of linear recesses 902 and 912 is equal to the width of the leg 804 through which it passes. However, varying lengths, widths, and heights may be substituted without departing from the scope hereof (e.g., linear recesses 902 and/or 912 may be less than the width of the corresponding leg 804 and the card retained therein may be sized to fit within the narrower linear recesses).

As seen in this cross-sectional view, a first innermost vertical surface 1110 of linear recess 902*b* is substantially vertical and a second outermost vertical surface 1108 of linear recess 902*b* is tapered in an outward direction. Conversely, a first innermost vertical surface 1104 of linear recess 912*b* is tapered in an inward direction and a second outermost vertical surface 1102 of linear recess 912*b* is substantially vertical. Innermost vertical surface 1110 and outermost vertical surface 1102 provide interior support for a card inserted into linear recesses 902*b* and 912*b* whereas the tapering of outermost vertical surface 1108 and innermost vertical surface 1104 accommodate card sides of varying widths. That is, linear recesses 902*b* and 912*b* allow cards having thinner sides to be inserted closer to bottom surfaces 1106 and 1112 of linear recesses 912*b* and 902*b*, respectively, while allowing cards having thicker sides to be inserted to a point located at a farther distance from bottom surfaces 1106 and 1112. That is, cards having thinner sides may be inserted further within linear recesses 912*b* and 902*b* whereas cards have thicker sides may be inserted to a lesser degree within linear recesses 912*b* and 902*b*. However, linear recesses having non-tapered sides may be substituted without departing from the scope of the present invention.

Figure 12:
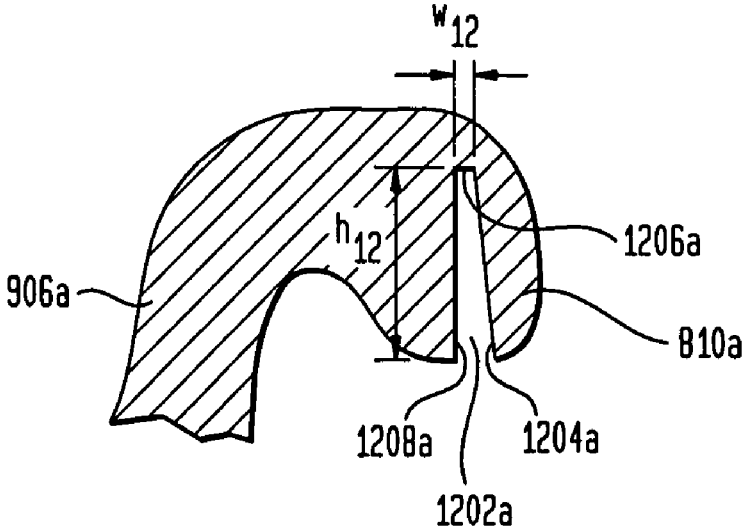
FIG. 12 is a cross-sectional view of the right upper retention mechanism of the apparatus depicted in FIG. 8 taken along lines 12-12 of FIG. 9.

Referring now to FIG. 12, depicted is a cross-sectional view of card display apparatus 800 without a card retained therein (such as depicted in FIG. 9) illustrating a cross-sectional view of arm 906*a* and upper paw 810*a*. In some embodiments of the present invention such as that depicted in FIGS. 8-12, arms or other forms of upper projections are included to provide upper support to the retained card. As depicted in the cross-sectional view of FIG. 12, the curvature of arm 906*a* allows upper paw 810*a* to fold over and support the top end of a card retained therein. An upper retention mechanism 1202*a* in the form of an inverted linear recess is located behind upper paw 810*a*. In this embodiment of the present invention, upper retention mechanism 1202*a* is transverse to the length of arm 906*a* and it is located near the distal end of arm 906*a*. Upper retention mechanism 1202*a* allows the top edge, or intersection of the front and back sides, of a tent-style card to be positioned therein such that the card may be retained in an upright state (such as seating card 802 as depicted in FIG. 8).

FIG. 12 illustrates the configuration of upper retention mechanism 1202*a*, which, in this embodiment of the present invention, is identical to upper retention mechanism 1202*b* (not shown) which is located behind upper paw 810*b* in an identical manner to that which upper retention mechanism 1202*a* is located behind upper paw 810*a*. In one embodiment of the present invention, the height $h_{12}$ of inverted linear recesses 1206 is approximately three-eighth of an inch (3/8") and the width $w_{12}$ of linear recesses 1206 tapers from a narrowest width of one-hundredth of an inch (1/100") at its uppermost point to a widest width of one thirty-second of an inch (1/32") at its lowermost point. In the embodiment of the present invention depicted in FIGS. 8-12, the length of upper retention mechanism 1202 are equal to the width of the arm 906 through which it passes. However, varying lengths, widths, and heights may be substituted without departing from the scope hereof (e.g., upper retention mechanism 1202 may be less than the width of the corresponding arm 906 and the card retained therein may be sized to fit within the narrower linear recesses).

As seen in this cross-sectional view, a first innermost vertical surface 1208*a* of upper retention mechanism 1202*a* is substantially vertical and a second outermost vertical surface 1204*a* of upper retention mechanism 1202*a* is tapered in an outward direction. Innermost vertical surface 1208*a* and outermost vertical surface 1204*a* provide interior support for a top end of a card inserted into upper retention mechanism 1202*a* whereas the tapering of outermost vertical surface 1204*a* accommodate a slightly open card, thereby allowing the bottoms of the front and back sides of the card to be inserted in linear recesses 902 and 912, respectively. However, inverted linear recesses having non-tapered sides may be substituted without departing from the scope of the present invention. Additionally, upper support (in the form of upper projections, upper arms, inverted linear recesses, or otherwise) may be omitted as it is not required to implement the present invention.

In one aspect of the present invention, card display apparatus 100, 500, and/or 800 are each molded as a single piece from a material such as clay or plastic. In one embodiment of the present invention, card display apparatus 100, 500, and/or 800 may be formed via injection molding. However, multi-pieced embodiments are also envisioned. Embodiments made from materials other than clay or plastic are also envisioned.

To facilitate the retention of a card via V-shaped retention mechanisms and/or upper and lower retention mechanisms, card display apparatus 100, 500, and 800 are created in the form of a bear sitting in an upright position and having outstretched or curled arms and legs. However, other non-bear characters may be substituted who are also sitting in an upright position with outstretched or curled arms and legs. Or, alternatively, forms other than four limbed characters may be substituted included, but not limited to, hobby figures, sports figures, seasonal figures, and holiday figures. For example, the other forms that may be substituted for a bear figurine holding a birthday greeting card include, without limitation: clowns (e.g., for birthday greetings); animals in a cast (e.g., for get well greetings); snowmen (e.g., for winter greetings); bunnies (e.g., for Easter greetings); Santa Claus (e.g., for Christmas greetings); a stack of presents in the form of a pyramid; a U.S. service bear or person; a balloon bouquet; and a fisherman having recesses in his boat. Virtually any form may be substituted without departing from the scope of the present invention. The form of card display apparatus 100, 500, and 800 may be further designed to add to an individual's home décor in manners including, without limitation, accentuating the season of the year, accentuating the personality of the owner, or celebrating a particular holiday. However, this home décor feature is not required to implement the present invention.

Although card display apparatus are described herein as a distinct entity from the card to be retained therein, embodiments of the present invention are envisioned in which the card display apparatus is given as a gift in conjunction with a card such as a greeting card or seating card. In such embodiments, the card may be permanently affixed to the card display apparatus (e.g., via adhesive) or detachable therefrom without departing from the scope of the present invention.

Furthermore, although embodiments of the present invention are depicted herein with the capability of retaining both sides of a vertically-or horizontally-oriented, two-sided card, alternate embodiments are envisioned for holding horizontal or vertical single-sided, or single paged, cards such as seating cards, picture cards, etc. In such embodiments, the single paged card, or a closed horizontally-oriented, double-paged card, is retained via one of the two retention mechanisms (e.g., linear recess, set of clips, etc.) and the other retention mechanism remains unused. Or, in another alternate embodiment, card display apparatus 100 includes a single retention mechanism. Such embodiments allow the card display apparatus to be given, for example, as wedding favors while also allowing such favors to hold a seating card.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An apparatus for displaying a card comprising:

a figurine; and at least two retention mechanisms internal to or coupled to said figurine, said at least two retention mechanisms configured to accept at least a portion of a bottommost surface of a card; and said at least two retention mechanisms arranged in a V shape;

wherein said figurine is a quadruped;

wherein at least one of said at least two retention mechanisms is located in or coupled to at least one leg of said quadruped; and wherein at least one of said at least two retention mechanisms is at least one of the group consisting of a linear recess, a clip, a magnet, and combinations thereof.

2. An apparatus according to claim 1, wherein said at least two retention mechanisms are located at an angle of approximately thirty degrees relative to an axis of symmetry.

3. An apparatus according to claim 1, wherein at least one of said at least two retention mechanisms is a linear recess;

wherein a first innermost vertical surface of said linear recess is substantially vertical; and wherein a second outermost vertical surface is tapered in an outward direction.

4. An apparatus according to claim 1, wherein said clip is spring-loaded.

5. An apparatus according to claim 1, wherein said clip includes an inward curvature.

6. An apparatus according to claim 1, wherein said card is irremovably coupled to said figurine.

7. An apparatus according to claim 6, wherein said card is irremovably coupled to said figurine via an adhesive.

* * * * *